United States Patent [19]

Rapp

[11] Patent Number: 5,060,884

[45] Date of Patent: Oct. 29, 1991

[54] CREEL FOR WARPING ARRANGEMENT HAVING SPOOL CORE DISCHARGE MEANS

[75] Inventor: Karl H. Rapp, Gros-Umstadt, Fed. Rep. of Germany

[73] Assignee: Karl Mayer Textilmaschinenfabrik GmbH, Obertshausen, Fed. Rep. of Germany

[21] Appl. No.: 554,267

[22] Filed: Jul. 17, 1990

[30] Foreign Application Priority Data

Jul. 20, 1989 [DE] Fed. Rep. of Germany ..... 3924095

[51] Int. Cl.[5] ..... B65H 49/14; B65H 67/02

[52] U.S. Cl. ..... 242/131.1; 242/41

[58] Field of Search ..... 242/131.1, 131, 130, 242/41; 414/331

[56] References Cited

U.S. PATENT DOCUMENTS 2,013,770 9/1935 Stein et al. ..... 242/131.1

3,460,689 8/1969 Furst ..... 242/131.1 X

FOREIGN PATENT DOCUMENTS 522353 4/1931 Fed. Rep. of Germany .

45649 6/1973 Japan .

*Primary Examiner*—Stanley N. Gilreath

*Attorney, Agent, or Firm*—Omri M. Behr

[57] ABSTRACT

A creel for a warping arrangement has a closed circuit carrier with a plurality of pegs for circulating them in a circulation direction. The pegs are adapted to receive thread spools and are distributed along the circulation direction upon the closed circuit carrier. The closed circuit carrier can stop in one of a plurality of predetermined positions to place one or more of the pegs in a thread take-off position. The creel also has a discharge arrangement for discharging the thread spools from those of the pegs arriving at the take-off position, in response to the carrier moving in the circulation direction. The discharge arrangement has a guide with a guide surface. The pegs each have an axial slit. The guide surface is positioned with respect to the carrier to cause the guide surface to protrude into the axial slit of the pegs as successive ones of the pegs move in the circulation direction and into proximity to the guide surface.

6 Claims, 2 Drawing Sheets

CREEL FOR WARPING ARRANGEMENT HAVING SPOOL CORE DISCHARGE MEANS

BACKGROUND OF THE INVENTION

1. Field of the Invention

The invention is directed to a creel for a warping arrangement, provided with pegs for carrying thread spools which are circumferentially distributed upon a continuous carrier, said carrier being stopable in certain predetermined positions in which a portion of the said pegs are in a thread take-off position. There is further provided a discharge arrangement having a guide surface for the thread spools which discharges said thread spools from said pegs when the carrier is moved forwardly into the discharge position.

2. Discussion of the Prior Art

In a known creel (Japan, Kokai, SHO 48-45649), there is provided a carrier formed by two chains which are connected to each other by means of transverse rods. The pegs project perpendicularly to these transverse rods. Each chain runs over two turning rollers, which are oriented vertically above each other. The pegs project straight out from the carrier. In this arrangement, the chains are set in motion when the thread has been run off from the spools. At predetermined intervals, the chains are halted so that a service person may remove the empty thread spools from the pegs and replace them with new thread spools without the need to mount a ladder to place the thread spools on pegs located in the upper reaches of the transport means. It is also provided in this arrangement that the empty thread spool cores drop down by force of gravity so that the pegs are cleared to enable a new thread spool to be placed thereon.

This known arrangement suffers from the disadvantage that the empty spool cores must be removed by hand. In particular, if the peg is slightly oriented downwardly, which can occur when the weight of the spool is high, protective measures must be taken to ensure that the thread spool is not pulled off from the peg by the force of the thread tension in combination with its own weight. This can be achieved by providing a certain measure of friction on the peg, or by providing a blocking means for the thread spool. However, such a blocking means or mechanism, for example a friction surface, interferes with the gravity discharge of the empty cores so that the service person is forced to removed the empty spools from the pegs before a new thread spool can be provided. This leads to a substantial consumption of service time.

A creel of the above described type provided with carrier pegs for the thread spools which are circumferentially distributed about a circulating carrier, wherein the carrier is haltable in certain predetermined positions is known. Such an arrangement, in which a portion of the pegs are in a thread take-off position and a discharge arrangement having guide surfaces for the thread spools is provided, which discharges the spools from the pegs when the carrier moves past the discharge arrangement, is disclosed in Patent DE PS 522 353. Such a discharge arrangement is provided by a plurality of surfaces having openings therebetween. In such an arrangement, the surfaces must be oriented exactly parallel to the direction of movement of the carrier, across their entire operating length. When two adjacent plates are not exactly oriented with respect to each other, the height of the discharge edge on both sides of the opening is uneven, which can lead to a disorientation of the spools on the pegs. Such disoriented spools can, under certain circumstances, not be removed from the pegs by the discharge arrangement but rather bend the discharge arrangement even further so that in the processing of the next set of spools, the spools which are mounted on pegs protruding through such adjacent openings, cannot be removed properly either.

Since however, it is necessary to provide all plates with spools, it is substantially impossible to maintain an exact mutual orientation of all the plates with respect to each other over a prolonged period of time. Thus, the service personnel not only need to charge the spools on the pegs, but must also pay close attention to the discharge of the spools in order to make the proper adjustments, that is to say, remove disoriented spools from the appropriate pegs.

U.S. Pat. No. 3,460,689 describes a moveable creel cart for a warping creel which is moveable against the discharge arrangement. In this discharge arrangement, discharge surfaces are provided which grip behind the empty spools and force them off the pegs. The discharged spools can thus be removed into an appropriate container by means of a transport band.

SUMMARY OF THE INVENTION

The purpose of the present invention is to provide a creel which allows the problem-free change of spools. This desired end is achieved by superceding the forces which hold the empty spool cores on the pegs without disorienting the spools and that the thread spools, that is to say, the empty cores, are removed from the appropriate pegs. The service person is then free to place a new spool on the now empty peg. This simplifies the servicing of the equipment considerably. This procedure is particularly advantageous when operating with a carrier provided with a regular distribution of pegs. In such an arrangement, the new, full, thread spools are provided on the opposite side from that on which the threads are being wound off.

In such an arrangement, the spooling change, that is to say, the replacement of the empty spools, can be accomplished in a few seconds merely by rotating the carrier through a half cycle. The service person must utilize an assistance arrangement in order to charge the empty pegs which are located relatively high on the arrangement. However, since such a service person can concentrate upon the placement of full spools without being concerned with the removal of the empty cores, such work is substantially less dangerous and can be carried out fall more quickly than heretofore. Since the guide surface always runs through the axial slit in the peg, the discharge of the thread spool is always achieved by a centrally oriented force. This avoids a force with a sidewards component which can lead to the disorientation of the core on the peg and thus to a blocking or damaging of the creel. The impact point of the force which forces the thread spools from the peg runs through the axis of the spool. Thus, it is substantially impossible to generate a moment which would disorient the spools on the peg, since there is substantially no leverage component to this force. Since the pegs have an axial slit, the ends thereof penetrating into the thread spool have a fork-shape. By providing the tines of the fork with a small additional distal separation, it is possible to provide a pretensioning which maintains the spools on the peg. The provision of such a pretensioning and the maintenance of the thread spools on the peg may be carried out in a rather simple manner to which the discharge arrangement can be very readily provided.

Care must however be taken that the guide surface penetrates into the axial slit of the peg. A force then operating on the spools thus only has a component operating in the longitudinal direction of the peg. A force perpendicular to this direction is not generated. Furthermore, the invention provides that the thread spool core on each and every peg is removed by the discharge arrangement even if the internal diameter of the core is only minimally greater than the diameter of the peg. In the arrangements heretofore known to the art, the possibility existed that a peg carrying a very thin core may run through the slit of the discharge surfaces without the discharge surfaces coming into operation.

In a preferred modification of the invention, the carrier runs in a substantially vertical plane and the discharge arrangement is located proximal to the lowest position of the carrier. This has the advantage that the empty cores are removed relatively far below the pegs. The drop distance is thus reduced. There is therefore no danger that the discharged thread cores damage other spools in their path.

It is advantageous to provide a transport band in the vicinity of the discharge arrangement. The task of this transport band is to carry the empty cores away from the vicinity of the creel. This ensures that the location under and next to the creel is kept free of interfering elements upon which service personnel could slip and be injured.

Furthermore, such a transport band enables the cores to be brought into a common collection point which simplifies the collection of the individual cores. This approach enables the changing of the thread spools to occur in a more rapid and agreeable manner.

It has been found to be advantageous to provide the transport arrangement to be substantially perpendicular to the rotational direction of the carrier. Thus, the cores are also transported perpendicular to the creel. It is thus possible to accumulate them at a location where service personnel can readily process them without becoming involved with running threads which, for example, are being warped on a beam.

In a preferred embodiment, the one end of guide surface is provided proximal to the carrier wherein the separation between the carrier and the guide surface from one of its ends to the other, is continually increased. Thus, it is possible to provide a relatively narrow guide surface, since it must pass through the peg itself. The discharge means acts upon the side of the core facing the carrier and by means of the steadily increasing distance during the travel path, pushes the core away from the carrier peg.

This continuous increase in size does not give rise to any type of reverse load which can negatively influence the motion of the carrier. In fact, particularly when the separation between the guide surface and the carrier increases in a regular fashion, a similar increase in speed of removal of the spool core may be achieved. The movement path of the empty cores is relatively readily predeterminable so that the transport band can be located in the correct position.

It is advantageous if the discharge arrangement is located below the lowest point of the carrier and is curved. This format enables advantage to be taken from the fact that at its lowest position, the carrier moves over a turning means, for example, a turning roller. A certain amount of room must be provided below the turning roller so that the pegs may move freely. This space can be utilized to locate the discharge arrangement. Since the carrier turns in this particular location, the curvature of the guide surface is related to the curvature of the carrier.

BRIEF DESCRIPTION OF THE DRAWINGS

The invention may be explained, with respect to the preferred embodiments, by reference to the drawings which show.

Figure 1:
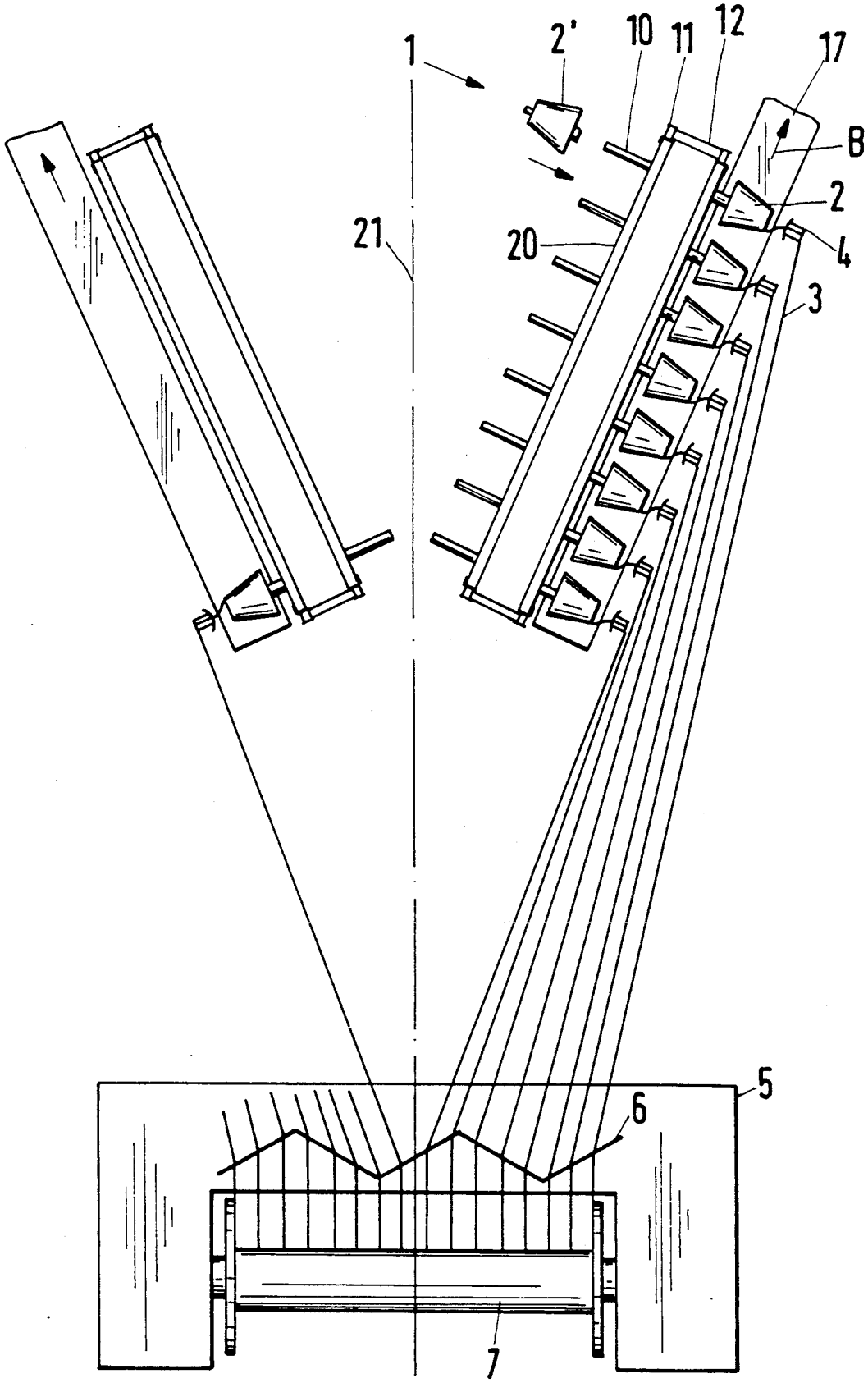
FIG. 1—a "V" creel in combination with a warping arrangement shown in partial plan view.

A plurality of spools 2 each carry a thread 3 are located on a creel 1. Each of said threads run over a thread brake 4 to a warping arrangement 5 where it is lead over a main reed 6 and onto a beam 7.

Each thread spool 2 is located upon a peg 10. Each of said pegs is located upon a carrier bar 20 and oriented perpendicular thereto. A plurality of carrier bars 20 are provided which run parallel to each other. The carrier bars 20 are located on both sides of a chain 11. The chain 11 is an endless chain which runs over two turning points around which turning rollers 12 and 13 respectively rotate. Turning roller 12 may be driven by motor 14. The two segments running over turning rollers 12 and 13 run substantially parallel to each other.

Figure 2:
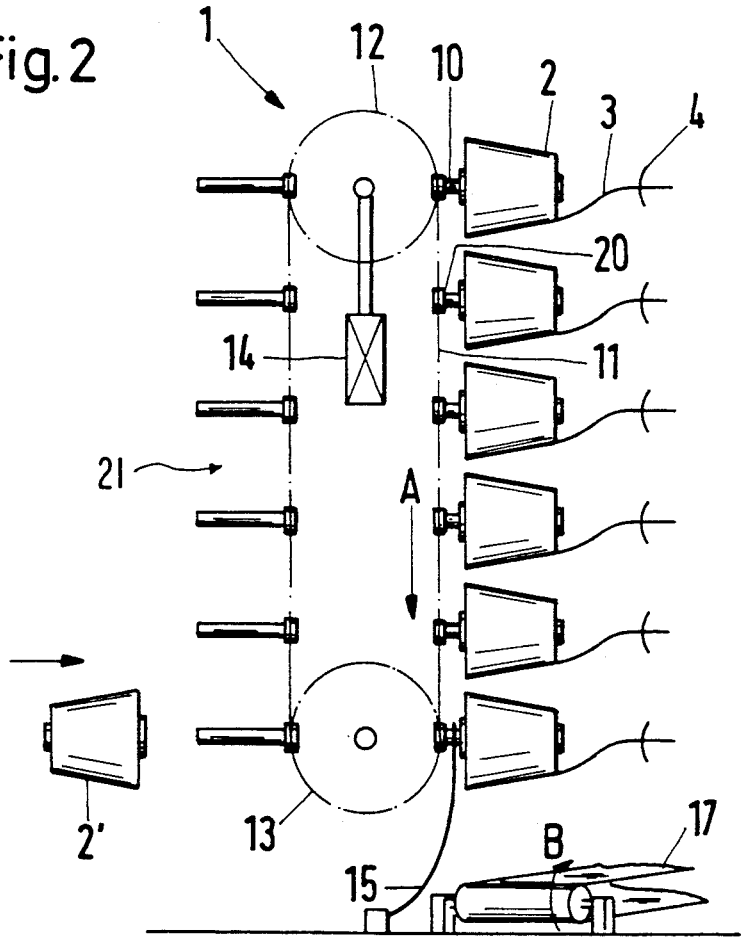
FIG. 2 is a side elevational view of the creel.

FIG. 1 shows a downward plan view on creel 1, whereas FIG. 2 shows a side elevational view of the creel. In FIG. 1, only the right side of the V-creel is shown with substantial detail. The left-half is only indicated schematically. Nevertheless, the detailed structure of the left-hand side mirrors the right-hand side.

The carrier rods 20 and the chain 11 taken together, form a moveable carrier which can circulate and be halted at predetermined positions. In one of these positions, the thread spools 2 are located in the take-off position. At the other end of the same side of the creel, that is to say, in the vicinity of the lower turning roller 13, there is located the discharge arrangement 15. The discharge arrangement 15 comprises a guide surface 18 whose free end is proximal to carrier 11. The separation between the guide surface 18 and carrier 11 continually increases from its free end 24 to its fastened end 23.

Figure 3:
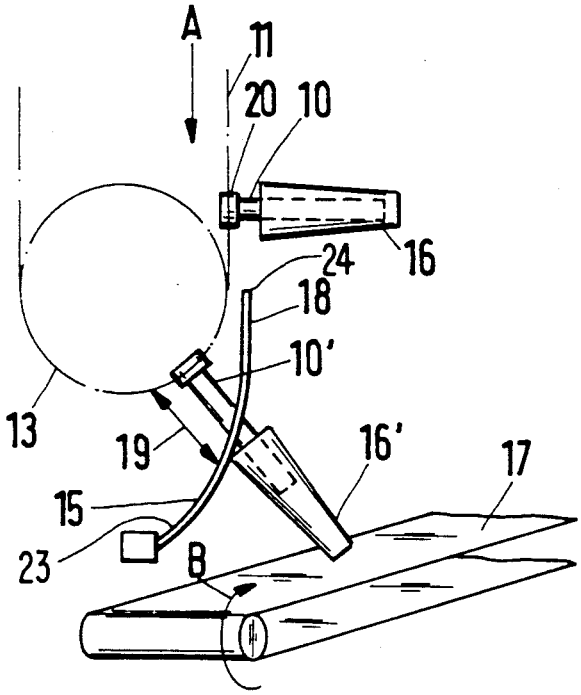
FIG. 3 is a slightly magnified view of the lower segment of FIG. 2.
Figure 4:
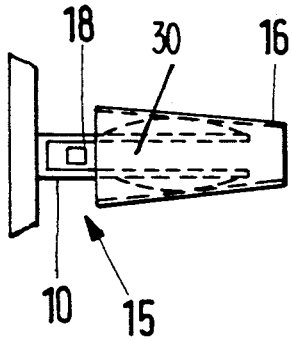
FIG. 4 is a downward plan view on the guide surface as viewed from 4—4 of FIG. 4.

For each bank of the thread spools 2, that is to say, for each series the pegs 10 located behind each other (as shown in FIG. 2 in direction of arrow A) there is provided a single discharge arrangement 15. The guide surface 18 is thus oriented that it always protrudes into axial slit 30 of a peg 10. Thus, the guide surface runs between the carrier 11 and the thread spool 2 and pushes thread spool core 16, when the carrier moves in the direction of arrow A. The movement path appropriate thereto is illustrated in FIG. 3.

An empty core located on peg 12 is driven by the movement of chain 11 in the direction of arrow A onto the free end 24 of discharge arrangement 15. As the chain 11 moves further, the guide surface 18 of the discharge arrangement 15 runs between the thread spool core 16 and the carrier 11. As can be seen by observation of another thread spool core 16', the distance between the thread spool core 16 and the carrier 11 has already been substantially increased by the discharge arrangement 15, so that the thread spool core 16' is substantially totally discharged from the peg 10'. At a particular point in time, the thread spool core 16' looses its hold on peg 10' and drops down. It is of course conceivable that the discharge arrangement 15 moves the thread spool core 16' completely off the peg 10'.

A transport band 17 which runs in the direction of arrow B, is located on the floor above the potential contact point of the thread spool core 16. The empty thread spools 16 thus fall onto the transport band and are transported away from the creel, for example, to a gathering point, where the service personnel can safely remove them without fear that they get into contact with moving threads. The transport bands 17 can also transport the empty thread spool cores directly to a trash container.

After the empty thread spool cores 16 are removed from the pegs 10, the pegs are thus free and can be charged with new, that is to say, fully wound thread spools 2'. These are provided on the inner side 21 of creel 1. While the threads are being beamed, the service person has sufficient time to provide the empty pegs 10 with new thread spools 2'. If the threads which are in the take-off position become empty, motor 14 drives chain 11 over tuning roller 12 in the direction of arrow A so that the thus emptied thread spool cores are moved downwardly. There they are discharged from the pegs 10. At the same time, new thread spools 2' are brought into the take-off position. The whole process can be carried out relatively quickly. By recharging the creel during the run time of the thread warping arrangement, run stoppage of said warping arrangement for a substantial period of time can be avoided. The thread spool cores can be automatically discharged and removed which provides that the area around the spool creel is always free of extraneous cores, that is to say, free of dangerous trash on which the service personnel can fall or by which they could thus be injured.

I claim:

1. In a creel for a warping arrangement comprising a closed circuit carrier having a plurality of pegs for circulating them in a circulation direction, said pegs being adapted to receive thread spools, said pegs being distributed along the circulation direction upon said closed circuit carrier, said closed circuit carrier being stopable in one of a plurality of predetermined positions to place one or more of said pegs in a thread take-off position, said creel further being provided with a discharge arrangement for discharging the thread spools from those of said pegs arriving at said take-off position in response to said carrier moving in the circulation direction, the improvement comprising providing in combination with said discharge arrangement:

a guide having a guide surface, said pegs each having an axial slit, said guide surface being positioned with respect to said carrier to cause said guide surface to protrude into the axial slit of said pegs as successive ones of said pegs move in said circulation direction and into proximity to said guide surface.

2. A creel in accordance with claim 1, characterized thereby that the carrier moves in a substantially vertical plane and the discharge arrangement is located proximate to the lowest point of said carrier.

3. A creel in accordance with claim 1, characterized thereby that a transport band is provided proximate to the discharge arrangement.

4. A creel in accordance with claim 3, characterized thereby that the transport band is moveable in a direction substantially perpendicular to the circulation direction of the carrier.

5. A creel in accordance with claim 1, wherein the guide surface has a pair of ends located alongside said carrier, the separation between the carrier and the guide surface increasing from one of said pair of ends to the other.

6. A creel in accordance with claim 1, wherein the discharge arrangement is curved and has one of its ends below the lowest portion of the carrier.

* * * * *